US007097424B2

(12) United States Patent
Cunha et al.

(10) Patent No.: US 7,097,424 B2
(45) Date of Patent: Aug. 29, 2006

(54) MICRO-CIRCUIT PLATFORM

(75) Inventors: Frank Cunha, Avon, CT (US); Keith Santeler, Middletown, CT (US); Bret Teller, Meriden, CT (US)

(73) Assignee: United Technologies Corporation, Hartford, CT (US)

( * ) Notice: Subject to any disclaimer, the term of this patent is extended or adjusted under 35 U.S.C. 154(b) by 58 days.

(21) Appl. No.: 10/771,485

(22) Filed: Feb. 3, 2004

(65) Prior Publication Data

US 2005/0169753 A1 Aug. 4, 2005

(51) Int. Cl.
*F01D 5/18* (2006.01)

(52) U.S. Cl. ..... 416/97 R

(58) Field of Classification Search ..... 416/97 R, 416/95, 96 R; 415/115
See application file for complete search history.

(56) References Cited

U.S. PATENT DOCUMENTS 4,017,213 A * 4/1977 Przirembel ..... 416/97 A
5,062,768 A * 11/1991 Marriage ..... 416/97 R
5,340,278 A * 8/1994 Magowan ..... 416/96 R
5,413,458 A * 5/1995 Calderbank ..... 415/115
6,120,249 A * 9/2000 Hultgren et al. ..... 416/97 R
6,179,565 B1 * 1/2001 Palumbo et al. ..... 416/97 R
6,390,774 B1 5/2002 Lewis et al.

* cited by examiner

*Primary Examiner*—Edward K. Look
*Assistant Examiner*—Devin Hanan
(74) *Attorney, Agent, or Firm*—Bachman & LaPointe

(57) ABSTRACT

A gas turbine engine component, such as a high pressure turbine blade, has an airfoil portion, a platform, and micro-circuits within the platform for cooling at least one of a platform edge adjacent the pressure side of the airfoil portion and the trailing edge of the platform. The micro-circuits include a first micro-circuit on a suction side of the airfoil and a second micro-circuit on a pressure side of the airfoil. The micro-circuits within the platform achieve high thermal convective efficiency, high film coverage, and high cooling effectiveness.

25 Claims, 2 Drawing Sheets

MICRO-CIRCUIT PLATFORM

STATEMENT OF GOVERNMENT INTEREST

The Government of the United States of America may have rights in the present invention as a result of Contract No. F33615-02C-2202 awarded by the U.S. Department of the Air Force.

BACKGROUND OF THE INVENTION (a) Field of the Invention

The present invention relates to an improved turbine engine component having a micro-circuit for cooling the platform of said turbine engine component.

(b) Prior Art

Present configurations for the airfoil portion of a turbine blade do not use dedicated cooling to relieve platform distress, particularly at the edges. As a consequence, severe oxidation and erosion occurs at the edge of the platform. This oxidation and erosion can lead to cracking which affects the turbine blade structurally. Platform cracks tend to propagate towards the airfoil fillet and link up with other cracks originating from other high stress concentration areas on the airfoil and the platform. Enlarging the flow areas between adjacent platforms to deal with oxidation and erosion provides a way for parasitic leakage air to affect adversely the intended performance for the engine.

One way to resolve these limitations, without changing the airfoil design is to introduce more cooling flow which in turn affects the overall engine performance. Since this configuration is not acceptable, a new configuration design is required. Ideally, this new configuration should not increase the coolant flow for cooling.

SUMMARY OF THE INVENTION

Accordingly, it is an object of the present invention to provide a turbine engine component having a new configuration design which achieves high thermal convective efficiency, high film coverage, and high cooling effectiveness.

It is a further object of the present invention to provide a turbine engine component which in the region of the platform has a substantial reduction in metal temperature gradients and an increase in thermal fatigue life.

The foregoing objects are attained by the turbine engine component of the present invention.

In accordance with the present invention, a turbine engine component broadly comprises an airfoil portion having a pressure side and a suction side, a platform adjacent a root portion of the airfoil portion, the platform having a leading edge and a trailing edge, and means within the platform for cooling at least one of a platform edge adjacent the pressure side of the airfoil portion and the trailing edge.

Other details of the micro-circuit platform of the present invention, as well as other objects and advantages attendant thereto, are set out in the following detailed description and the accompanying drawings wherein like reference numerals depict like elements.

DETAILED DESCRIPTION OF THE PREFERRED EMBODIMENT(S)

Figure 1:
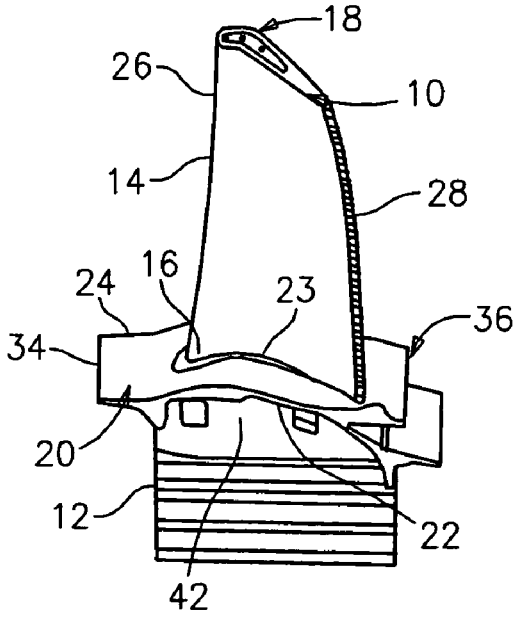
FIG. 1 illustrates a turbine blade use in a gas turbine engine.

Referring now to the drawings, FIG. 1 illustrates a turbine blade 10 to be used in a gas turbine engine. The turbine blade 10 has a fir tree 12 for joining the blade to a rotating member such as a disk, an airfoil portion 14 having a root portion 16 and a tip 18, and a platform 20 having an underside 22 and an upper surface 24. The airfoil portion 14 has a leading edge 26, a trailing edge 28, a suction side 30, and a pressure side 32. The platform 20 has a leading edge or front rim 34, a trailing edge or aft rim 36, a suction side edge 38, and a pressure side edge 40. The turbine blade 10 also has a pocket 42 adjacent the underside 22 of the platform 20. While FIG. 1, only shows one pocket 42, there is a corresponding pocket on the other side of the turbine blade 10. During operation, the pockets 42 typically receive cooling air which is bled from a portion of the engine such as the high pressure compressor.

Figure 2:
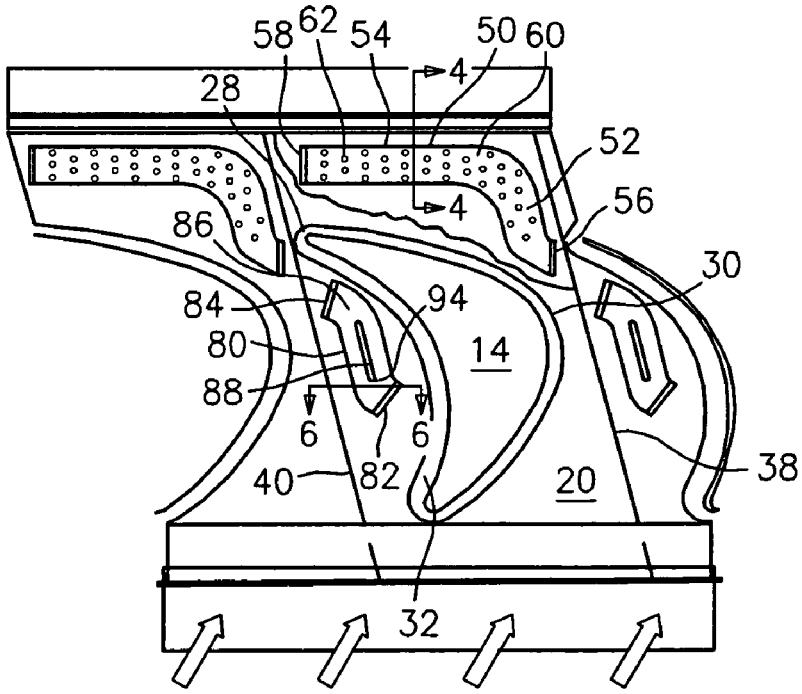
FIG. 2 is a top view of a platform portion of the turbine blade with cutaway portions showing the micro-circuits of the present invention.
Figure 3:
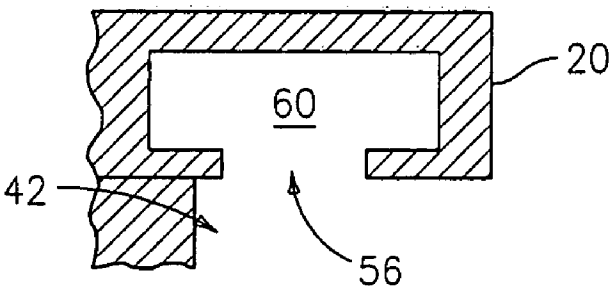
FIG. 3 is a sectional view of a portion of the platform of FIG. 2 showing the inlet for the suction side micro-circuit.
Figure 4:
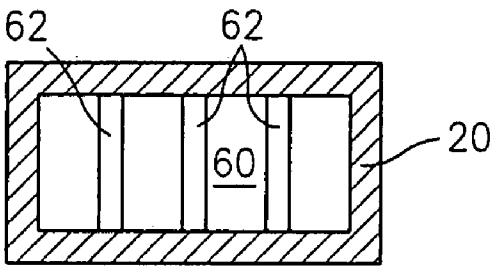
FIG. 4 is a sectional view taken along lines 4—4 in FIG. 2.

Referring now to FIGS. 2–4, a first micro-circuit 50 is provided within the platform 20 between the suction side 30 of the airfoil portion 14 and the platform trailing edge 36. The micro-circuit 50 is L-shaped, although it may have any other suitable configuration as needed. The micro-circuit 50 has a first leg 52 which extends between the suction side 30 and the suction side edge 38 and a second leg 54 which extends parallel to and along the trailing edge 36.

The micro-circuit 50 is provided with an inlet 56 which is located on the underside 22 of the platform 20 and which receives cooling air (engine bleed air) from a pocket 42. The micro-circuit 50 also has an outlet 58 which is located on the upper surface 24 of the platform 20 and which blows cooling air over the trailing edge 36. Preferably, the inlet 56 and the outlet 58 each take the form of a slot. The inlet 56 is preferably located about a distance from the front rim 34 of from 60 to 70% of the span of the platform 20 from its front rim 34 to its aft rim 36.

A cooling fluid passageway 60 extends from the inlet 56 to the outlet 58 and has a distance D. In a preferred embodiment of the present invention, the cooling fluid passageway 60 has a height H in the range of from 15 to 25 mils. In a preferred embodiment of the present invention, the D:H ratio should be 1 or higher. If the D:H ratio is lower than 1, the features used to provide cooling are less effective.

With regard to increasing cooling effectiveness, incorporated within the micro-circuit 50 and within the platform 20 are a plurality of pedestals 62. The pedestals 62 are preferably staggered so as to create a more turbulent flow which increases the cooling effectiveness.

At the outlet 58, the pressure should be at least 3% greater, and preferably at least 5% greater, than the sink pressure of the turbine engine component in this region.

Figure 5:
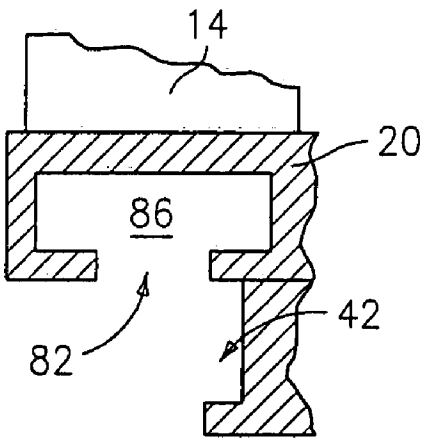
FIG. 5 is a sectional view of a portion of the platform of FIG. 2 showing the inlet for the pressure side micro-circuit.
Figure 6:
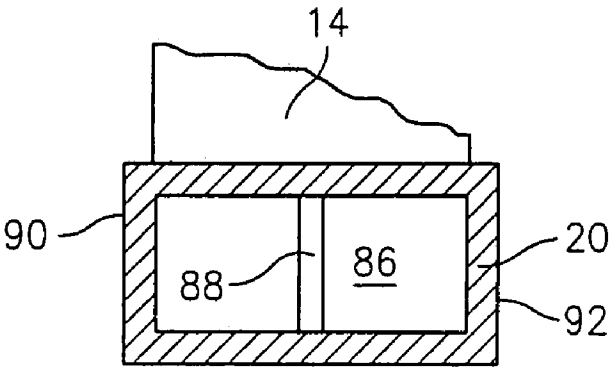
FIG. 6 is a sectional view taken along lines 6—6 in FIG. 2.

Referring to FIGS. 2, 5, and 6, a second micro-circuit 80 is formed within the platform 20. The second micro-circuit 80 is position between the pressure side 32 of the airfoil portion 14 and the pressure edge 40 of the platform. The second micro-circuit 80 has an inlet 82 on the underside 22 of the platform 20 and an outlet 84 which is on the upper surface 24 of the platform 20. Both the inlet 82 and the outlet 84 preferably take the form of a slot.

The inlet 82 preferably is located at a distance from the front rim 34 of about 33% to 50% of the span of the platform 20 from the front rim 34 to the aft rim 36. The micro-circuit 80 has a cooling fluid passageway 86 which extends a distance D from the inlet 82 to the outlet 84. Within the fluid passageway 86 is a means 88 for preventing hardware distress, which distress preventing means 88 preferably takes the form of an elongated island spaced from the sidewalls 90 and 92 of the fluid passageway 86. The distress preventing means 88 preferably has a leading edge 94 which is located from the inlet 82 by a distance which is 50–60% of the distance D. The thickness of the distress preventing means 88 should be about 40% of the width W of the fluid passageway 86. The distress preventing means may have any suitable length.

The outlet 84 is preferably oriented to blow cooling air onto the platform in a region adjacent the edge 40, particularly in the region of the fillet 23 where cracking may occur. In a preferred embodiment of the present invention, the fluid passageway 86 has a height H in the range of from 15 to 25 mils. As before, the ratio of D:H should be 1 or greater. Further, the pressure at the outlet 84 should be at least 3%, and preferably at least 5%, greater the sink pressure in the region of the outlet 84.

In order to achieve the objectives of the present invention, it is desirable that the pressure at both of the inlets 56 and 82 be in the range of 55 to 65% of the pressure at the engine compressor station ($P_3$) which has the point of highest pressure. It has been found that using the micro-circuits 50 and 80 of the present invention, one can achieve a pressure at the outlet 58 in the range of from 30% to 40% $P_3$ and a pressure at the outlet 84 in the range of 45% to 55% $P_3$. It has also been found that one can achieve convection efficiencies of 40% to 50%, which is far better than the convection efficiency of 10% to 15% which may be achieved with other designs not having the micro-circuits of the present invention.

Further advantages attendant to the present invention is a substantial reduction of metal temperature at the edges 36 and 38, thus increasing oxidation life by a factor of at least 2× and eliminating platform edge distress.

In a preferred embodiment, the micro-circuits 50 and 80 have a constant metering section throughout to effectively reduce pressure from the microcircuit inlets 56 and 82 respectively to the microcircuit exits 58 and 84 respectively. The pedestals 62 in the micro-circuit 50 are preferably positioned so as to effectively maintain a constant coolant flow, which is preferably in the range of from 0.15% to 0.35% of the engine airflow at station 2.5. As a result of the design of the micro-circuits 50, one can achieve high micro-circuit cooling convective efficiency, reduce metal temperature gradients, and increase thermal fatigue life. The micro-circuits 50 and 80 also increase coolant heat pick-up. As a result, there is an increase in coolant temperature, which results in the increased convective efficiency.

The slot outlets 58 and 84 are beneficial in terms of providing high cooling film coverage. This enables the platform edges 36 and 38 to be protected from oxidation and erosion.

While the present invention has been described in the context of a turbine blade, the micro-circuit cooling of the present invention can be used in other gas turbine engine components which require a platform to be cooled.

It is apparent that there has been provided in accordance with the present invention a micro-circuit platform which fully satisfies the objects, means, and advantages set forth hereinbefore. While the present invention has been described in the context of specific embodiments thereof, other alternatives, modifications, and variations will become apparent to those skilled in the art having read the foregoing description. Accordingly, it is intended to embrace those alternatives, modifications and variations as fall within the broad scope of the appended claims.

What is claimed is:

1. A gas turbine engine component comprising:

an airfoil portion having a pressure side and a suction side;

a platform adjacent a root portion of said airfoil portion, said platform having a leading edge, a suction side edge, a pressure side edge, and a trailing edge;

means within said platform for cooling at least one of a platform edge adjacent said pressure side of said airfoil and said trailing edge, said cooling means having a first outlet for blowing cooling air onto the platform in a region adjacent the suction side edge;

wherein said platform cooling means includes a first micro-circuit within said platform adjacent said suction side; and wherein said first micro-circuit has an L-shape with a first leg extending along said suction side and a second leg extending in a direction parallel to said trailing edge.

2. A gas turbine engine component according to claim 1, wherein said first micro-circuit has an inlet on an underside of said platform and said outlet on an upper surface of said platform.

3. A gas turbine engine component according to claim 2, further comprising a fluid passageway extending from said inlet to said outlet and a plurality of pedestals within said fluid passageway for creating a turbulent flow within said passageway.

4. A gas turbine engine component according to claim 3, wherein said pedestals are staggered.

5. A gas turbine engine component according to claim 2, wherein said first micro-circuit has an inlet pressure in the range of 55 to 65% of the pressure at the engine compressor station ($P_3$) which has the point of highest pressure and an outlet pressure in the range of 30% to 40% $P_3$.

6. A gas turbine engine component according to claim 2, wherein said first micro-circuit has an outlet pressure which is at least 3% greater than sink pressure adjacent said outlet.

7. A gas turbine engine component according to claim 2, wherein said first micro-circuit has an outlet pressure which is at least 5% greater than the sink pressure adjacent said outlet.

8. A gas turbine engine component according to claim 2, further comprising at least one pocket adjacent an underside of said platform and said inlet communicating with said at least one pocket.

9. A gas turbine engine component according to claim 1, wherein said cooling means comprises a second micro-circuit within said platform extending between said pressure side of said airfoil portion and an edge of said platform.

10. A gas turbine engine component according to claim 9, wherein said second micro-circuit has an inlet on an underside of said platform, a second outlet on an upper surface of said platform, and a fluid passageway extending between said inlet and said second outlet.

11. A gas turbine engine component according to claim 10, wherein said second outlet of said second micro-circuit is located adjacent a trailing edge of said airfoil portion and introduces cooling air at a fillet between said platform and said trailing edge.

12. A gas turbine engine component according to claim 10, wherein said second micro-circuit has an inlet pressure in the range of 55 to 65% of the pressure at the engine compressor station ($P_3$) which has the point of highest pressure and an outlet pressure in the range of 45% to 55% $P_3$.

13. A gas turbine engine component according to claim 10, wherein said second micro-circuit has an outlet pressure which is at least 3% greater than sink pressure adjacent said second outlet.

14. A gas turbine engine component according to claim 10, wherein said second micro-circuit has an outlet pressure which is at least 5% greater than sink pressure adjacent said second outlet.

15. A gas turbine engine component according to claim 10, further comprising at least one pocket adjacent an underside of said platform and said inlet communicating with said at least one pocket.

16. A gas turbine engine component comprising:

an airfoil portion having a pressure side and a suction side;

a platform adjacent a root portion of said airfoil portion, said platform having a leading edge and a trailing edge;

means within said platform for cooling at least one of a platform edge adjacent said pressure side of said airfoil portion and said trailing edge;

said cooling means comprising a micro-circuit within said platform extending between said pressure side of said airfoil portion and an edge of said platform;

said micro-circuit having an inlet on an underside of said platform, an outlet on an upper surface of said platform, and a fluid passageway extending between said inlet and said outlet; and said micro-circuit having means for preventing hardware distress located within said passageway between said inlet and said outlet, said hardware distress preventing means being spaced from sidewalls of said passageway.

17. A gas turbine engine component according to claim 16, wherein said distress hardware preventing means has a leading edge which is located from said inlet by a distance which is 50% to 60% of the distance of said passageway.

18. A turbine blade for use in a gas turbine engine comprising:

an airfoil portion having a pressure side and a suction side;

a platform adjacent a root portion of said airfoil portion;

a first micro-circuit within said platform positioned between said pressure side of said airfoil portion and a pressure side of said platform, said first micro-circuit having cooling fluid flowing therethrough;

a second micro-circuit within said platform positioned between said suction side of said airfoil and an aft rim of said platform, said second micro-circuit having a cooling fluid flowing therethrough;

each of said first and second micro-circuits having a slot outlet for exhausting cooling fluid onto an upper surface of said platform; and said second micro-circuit having a fluid passageway extending from said inlet to said slot outlet and wherein means for preventing hardware distress is located within said fluid passageway.

19. A turbine blade according to claim 18, wherein each of said first and second micro-circuits has a slot outlet for exhausting cooling fluid onto an upper surface of said platform.

20. A turbine blade according to claim 19, wherein said slot outlet for said first micro-circuit exhausts said cooling fluid onto a trailing edge of said platform.

21. A turbine blade according to claim 19, wherein said slot outlet for said second micro-circuit exhausts said cooling fluid onto a trailing edge portion of said airfoil portion.

22. A turbine blade according to claim 19, wherein said first micro-circuit has means for creating a turbulent flow within a passageway extending from said inlet to said slot outlet.

23. A turbine blade according to claim 22, wherein said turbulent flow creating means comprises a plurality of staggered pedestals within said passageway.

24. A turbine blade according to claim 18, wherein each of said micro-circuits has an outlet oriented to blow cooling fluid onto the platform in the region adjacent a suction side edge of the platform.

25. A turbine blade according to claim 18, wherein said first micro-circuit is independent of said second micro-circuit.

* * * * *